US005440456A

United States Patent [19]

Bertling et al.

[11] Patent Number: 5,440,456

[45] Date of Patent: Aug. 8, 1995

[54] HEADLIGHT FOR VEHICLES

[75] Inventors: Johannes Bertling, Yaihingen; Heike Eichler; Henning Hogrefe, both of Reutlingen, all of Germany

[73] Assignee: Robert Bosch GmbH, Stuttgart, Germany

[21] Appl. No.: 229,473

[22] Filed: Apr. 18, 1994

[30] Foreign Application Priority Data

May 8, 1993 [DE] Germany ..... 43 15 393.3

[51] Int. Cl.[6] ..... F21M 3/12

[52] U.S. Cl. ..... 362/61; 362/309; 362/328; 362/329

[58] Field of Search ..... 362/61, 80, 308, 309, 362/328, 329

[56] References Cited

U.S. PATENT DOCUMENTS 1,393,573 10/1921 Ritter ..... 362/309
1,981,577 11/1934 Adler, Jr. ..... 362/309

FOREIGN PATENT DOCUMENTS 0365193 4/1990 European Pat. Off. .
535057 10/1931 Germany ..... 362/308
656609 2/1938 Germany ..... 362/308
188367 3/1937 Switzerland ..... 362/309

*Primary Examiner*—Stephen F. Husar
*Assistant Examiner*—Alan B. Cariaso
*Attorney, Agent, or Firm*—Michael J. Striker

[57] ABSTRACT

A headlight for a vehicle has a light source, a reflector reflecting light emitted by the light source as a light bundle converging at least in horizontal longitudinal planes, the reflector having a front edge facing in a light outlet direction, and a dispersing lens arranged in the region of the front edge of the reflector so that the light bundle reflected by the reflector passes through the dispersing lens, the reflector and the dispersing lens having shapes which are such and so determined relative to one another that the light emitted by the light source after reflection on the reflector and passage through the dispersing lens forms a light intensity distribution sufficient for requirements corresponding to regulations.

8 Claims, 4 Drawing Sheets

HEADLIGHT FOR VEHICLES

BACKGROUND OF THE INVENTION

The present invention relates generally to a headlight for a vehicle.

More particularly, it relates to a headlight for a vehicle which has a light source and reflector reflecting the light as at least in horizontal longitudinal planes converging light bundle, and a dispersing lens arranged in a front edge region of the reflector.

Headlights of the above mentioned general type are known in the art. One of such headlights is disclosed for example in the European patent document EP 0 365 193 A2. This headlight is formed as an antidazzle headlight and has an ellipsoidal reflector. A light source is arranged in the region of the inner focal point of the reflector and its light is reflected by the reflector as a light bundle converging both in a horizontal and in a vertical longitudinal plane. A dispersing lens is arranged in the region of a front edge of a reflector facing the light outlet direction and has a convex surface facing the reflector apex and an opposite concave surface. An antidazzle cap is located under the light source and prevents exiting of light on a part of the reflector located under a horizontal central plane which would be directed upwardly and lead to a dazzling. The light bundle which is reflected from the part of the reflector located above the horizontal central plane is deflected during passage through the dispersing lens so that it intersects the optical axis of the reflector between the outer focal point of the reflector and a measuring screen arranged in a 25 m before the reflector. Known optical elements such as prisms or lenses arranged on a cover disc which closes a light opening of the head lamp are provided for influencing of the light bundle reflected by the reflector and passing through the dispersing lens, in order to fulfill the regulations for the asymmetrical antidazzle light prescribed in accordance with corresponding regulations. This headlight has the disadvantage that only the light sent by the light source to the upper part of the reflector is utilized and therefore only low efficiency is provided. Moreover, the utilization of the cover disc provided with optical elements is disadvantageous since its manufacture is expensive and it has a high weight.

SUMMARY OF THE INVENTION

Accordingly, it is an object of the present invention to provide a headlight which avoids the disadvantages of the prior art.

In keeping with these objects and with others which will become apparent hereinafter, one feature of the present invention resides, briefly stated, in a headlight in which the shape of the reflector and the dispersion lens are selected and determined relative to one another so that the light emitted by the light source after reflection on the reflector and passage through the dispersion lens forms a prescribed sufficient illumination intensity distribution.

When the headlight is designed in accordance with the present invention, it utilizes the light emitted by the light source in an optimal manner since no screening cap is provided.

For obtaining illumination intensity distribution for fulfilling the requirements prescribed in accordance with corresponding regulations, only the reflector and the dispersing lens are provided, so that no cover disc with optical elements is needed. By means of new refraction methods it is possible to calculate the shape of the reflector and the dispersing lens so that the light emitted by the light source after reflection by the reflector and passage through the dispersion lens provides the required illumination intensity distribution, including an eventually required bright-dark limit. In contrast to known headlights which are formed in accordance with the projection system and have an ellipsoidal reflector, a screen forming the bright-dark limit, and a lens forming the screen, the inventive headlight has the advantage that its structural depth due to the lens arranged at the front edge of the reflector is substantially smaller. Moreover, the known headlights in accordance with the projection principle have the disadvantage that on the bright-dark limit due to the projection of the screen, color fringes occur. This is eliminated in the inventive headlight since here the bright-dark limit is formed by the corresponding reflection of the light emitted by the light source to the reflector.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
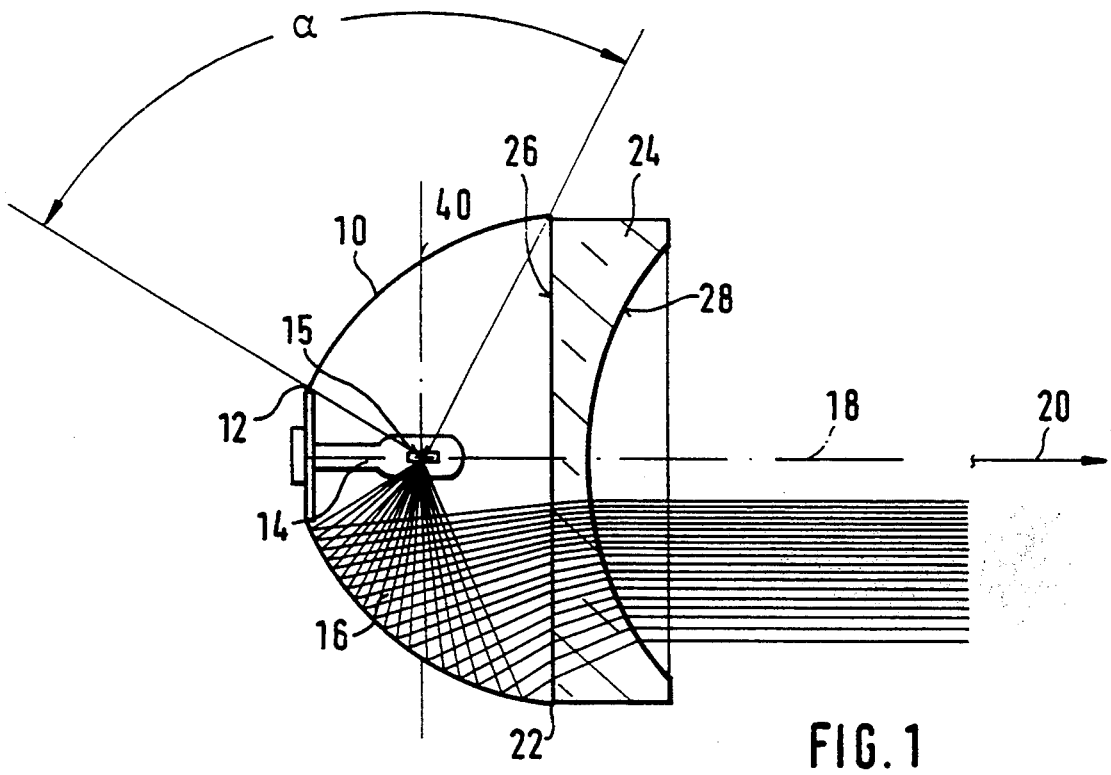
FIG. 1 is a view showing a vertical longitudinal section of a headlight in accordance with a first embodiment of the invention.
Figure 2:
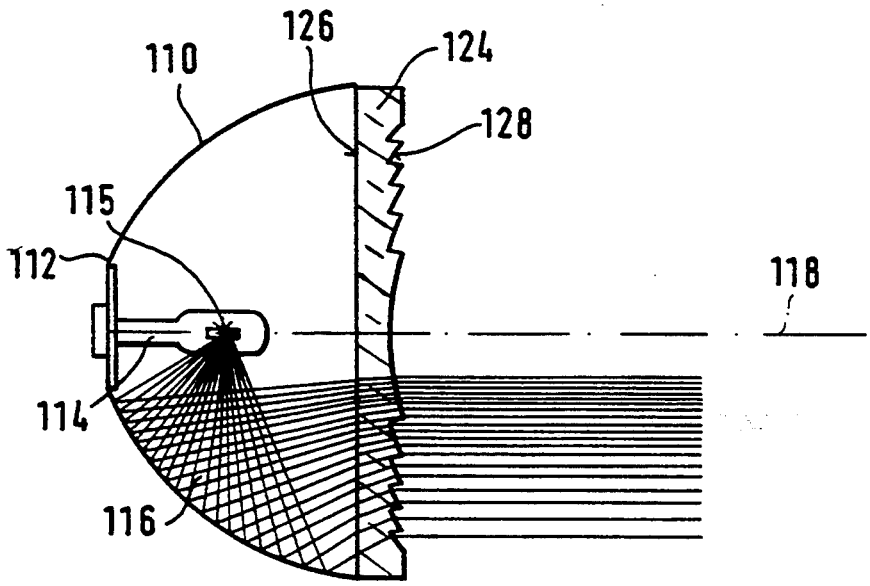
FIG. 2 is a view showing the headlight in accordance with the second embodiment of the invention.
Figure 3:
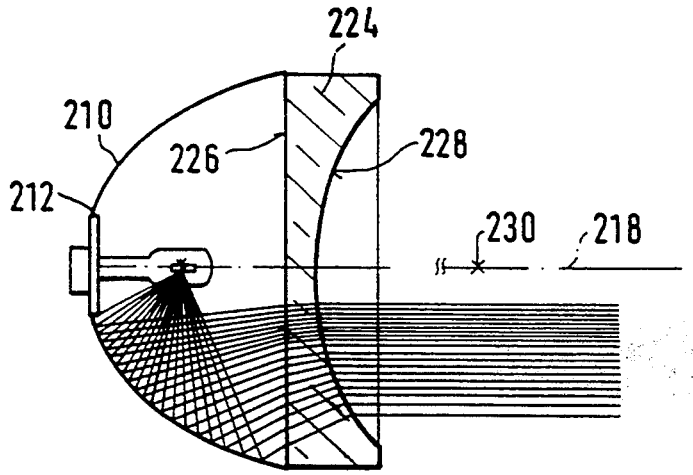
FIG. 3 is a horizontal longitudinal section of the headlight in accordance with a third embodiment of the invention.

A headlight for a vehicle, in particular a motor vehicle, shown in FIGS. 1–3 has a reflector 10 composed of metal or synthetic plastic material. A light source 14 is arranged in an apex 12 of the reflector 10 and can be formed as an incandescent lamp or a gas discharge lamp. Light emitted by the light source 14 is reflected by the reflector 10 as a light bundle 16 which converges in at least horizontal longitudinal planes. For this purpose the reflector 10 has for example in axial longitudinal sections which contain its optical axis 18, ellipse-like section curves. The term "ellipse-like" means that the section curves can be formed as exact ellipses or can have at least locally an elliptic curvature while in other regions they can deviate from an elliptic curvature. In different longitudinal sections, the section curves of the reflector 10 can be different, and their inner focal points substantially coincide while their outer focal points assume different positions. The light source 14 is arranged in the region of the inner focal point of the reflector 10. Due to this construction of the reflector 10 it surrounds the light source 14 over a great angular region $\alpha$ and catches a great part of the light stream emitted by the light source 14 for forming the light bundle.

In the first embodiment shown in FIG. 1 a dispersing lens 24 is arranged in the region of a front edge 22 of the reflector 10 which edge faces the light outlet opening 20. The dispersing lens 24 has a flat surface 26 facing toward the reflector apex 12 and the opposite concavely curved surface 28. The dispersing lens 24 can be however arranged in a reverse position, with its curved surface 28 facing toward the reflector apex 12. The thickness of the dispersing lens 24 increases starting from its center to its edges. The curved surface 28 can be spherical or aspherical and can have different curvatures in different axial longitudinal sections. The dispersing lens 24 can be composed of glass or synthetic plastic material and formed with such a size that it overlaps the light outlet opening of the reflector 10.

The light emitted by the light source 14 is reflected by the reflector 10 as a light bundle converging in horizontal and vertical longitudinal planes. The shape of the reflector 10 and the dispersing lens 24 are selected and determined relative to one another so that the light emitted by the light source 14 after deflection on the reflector 10 and passage through the dispersing lens 24 forms an illumination intensity distribution sufficient for requirements prescribed in accordance with regulations. For example the shape of the dispersing lens 24 is given and the shape of the reflector 10 is selected with consideration of the deflecting action of the dispersing lens 24 so that it reflects the light emitted by the light source 14 in a manner required for providing an illumination intensity distribution satisfying the requirements prescribed in accordance with regulations. Since the dispersing lens 24 is arranged in the region of the front edge 22 of the reflector 10, the headlight has a small structural depth.

FIG. 2 shows a second embodiment of the inventive headlight in which the dispersing lens 124 is formed as a fresnel lens. The fresnel lens 124 has a flat surface 126 facing a reflector apex 112 and an opposite surface 128 provided with several concentric lens ring surfaces. The fresnel lens 124 has a substantially identical thickness over its surface, so that in contrast to the dispersing lens 24 it has a lower weight. The fresnel lens 124 can be composed of glass or synthetic plastic as the dispersing lens 24.

Figure 3A:
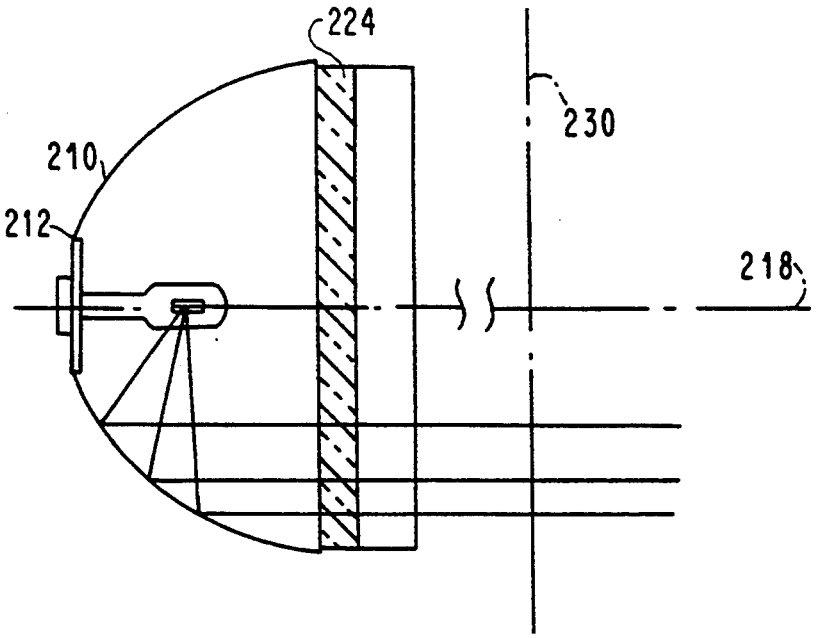
FIG. 3*a* is a vertical longitudinal section of the headlight of FIG. 3.

In the third embodiment shown in FIGS. 3 and 3*a* the dispersing lens 224 is formed as a cylindrical lens which has a flat surface 226 facing the reflector apex 212 and the opposite cylindrical surface 228. The cylindrical axis 230 of the cylindrical lens 224 is arranged vertically and perpendicularly to the optical axis 18 of the reflector 10. The cylindrical surface 228 can be a part of a circular cylinder or a part of a cylinder which in a cross-section is curved, for example parabolically, elliptically or in another way. The shape of the reflector 10 is determined so that the light emitted by the light source is reflected as a light bundle which converges in horizontal planes, but in vertical planes extends substantially parallel to the optical axis 28. During passage through the dispersing lens 224 the light bundle reflected by the reflector 210 is influenced in horizontal planes or in other words deflected, however, in the vertical planes the light bundle is not influenced by the dispersing lens 224.

The headlight in accordance with the above described embodiments can be formed as a high beam headlight, fog headlight or antidazzle headlight.

Figure 4:
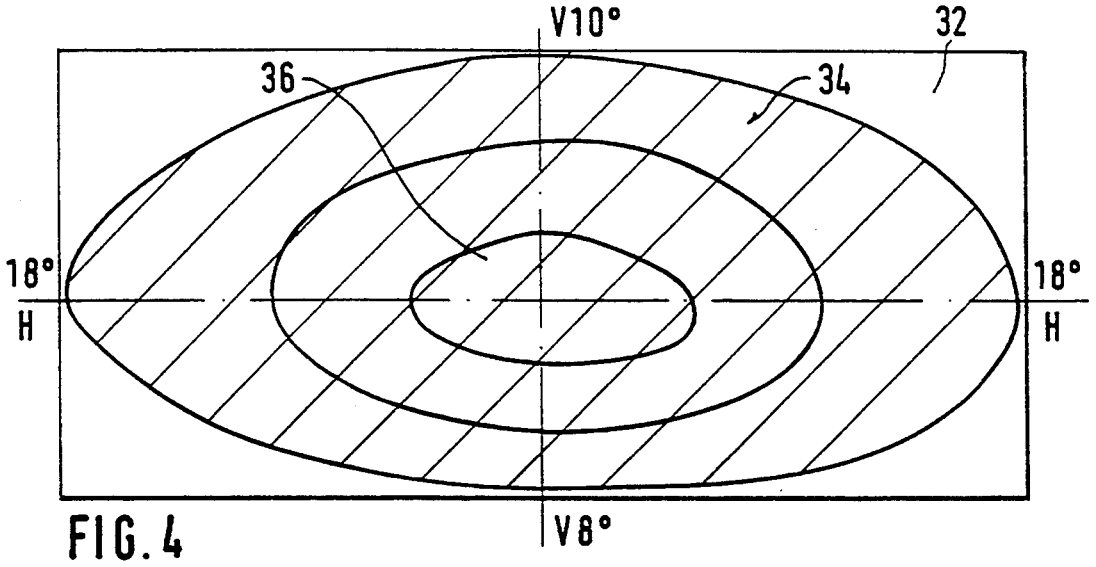
FIG. 4 is a view showing an illumination intensity distribution produced by the headlight when it is formed as a high beam headlight with a measuring screen.

FIG. 4 shows a measuring screen 32 which is arranged at a distance of for example 25 m from the reflector 10 perpendicularly to its optical axis 18. An illumination intensity distribution 34 is formed on the measuring screen 32 by the headlight and represented in FIG. 4 by several isolux lines which are the lines of the same illumination intensity. The illumination intensity distribution 34 shown in FIG. 4 is produced by the headlight formed as a high beam light. The illumination intensity distribution 34 has a horizontal extension of approximately 18 degree to both sides of a vertical central plane V—V of the measuring screen 32. In the vertical direction the illumination intensity distribution 34 extends approximately up to 10 degree above an approximately 8 degree below a horizontal central plane H—H of the measuring screen 32. The illumination intensity distribution 34 has a pronounced maximum 35 in the center of the measuring screen 32, in which the vertical central plane V—V and the horizontal central plane H-H intersect one another.

Figure 5:
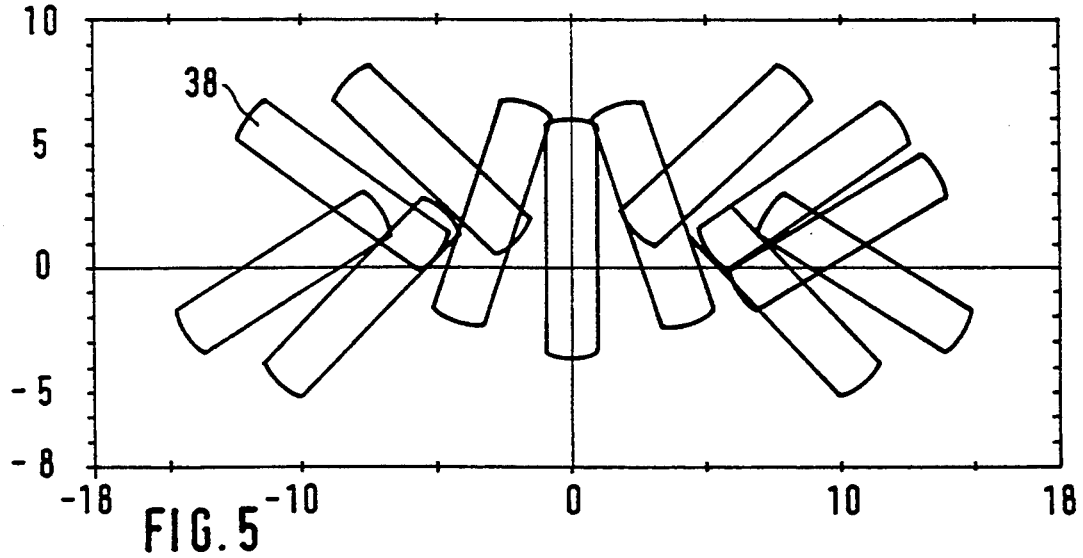
FIG. 5 is a view showing projections of a light body formed by a high beam headlight on a measuring screen.

FIG. 5 shows projections of the light source 14 produced on the measuring screen 32 by the high beam headlight. FIG. 5 shows for example only the projections 38 which are reflected from the regions of the reflector 10 arranged at a same diameter around the optical axis 18. The reflector regions, from which the projections 38 shown in FIG. 5 are reflected, are located approximately in a plane identified in FIG. 1 with reference numeral 40, approximately on half distance between the apex 12 and the greatest diameter D of the reflector 10. The light source 14, or in other words the incandescent coil in an incandescent lamp or a light arc in a gas discharge lamp, extend substantially parallel to the optical axis 18 and is arranged substantially on it.

Figure 6:
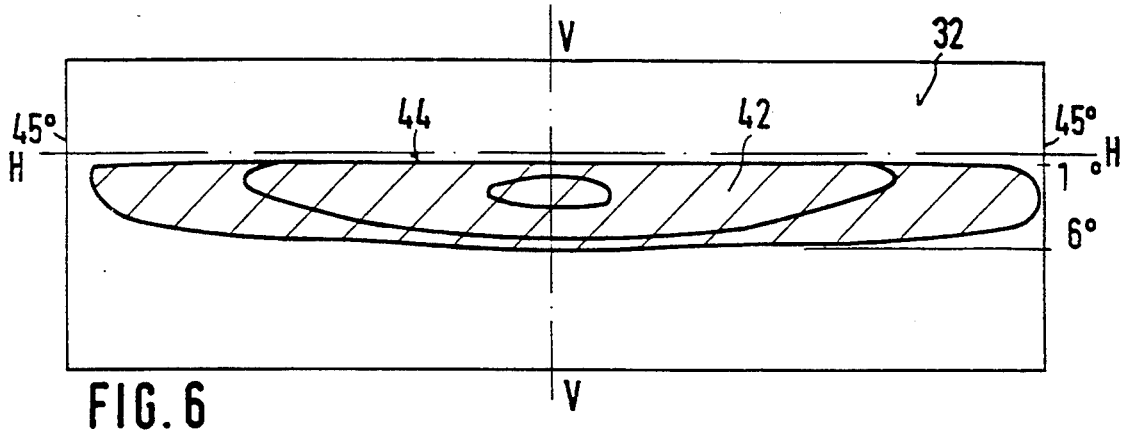
FIG. 6 is a view showing an illumination intensity distribution produced on the measuring screen by a headlight formed as a fog headlight.
Figure 7:
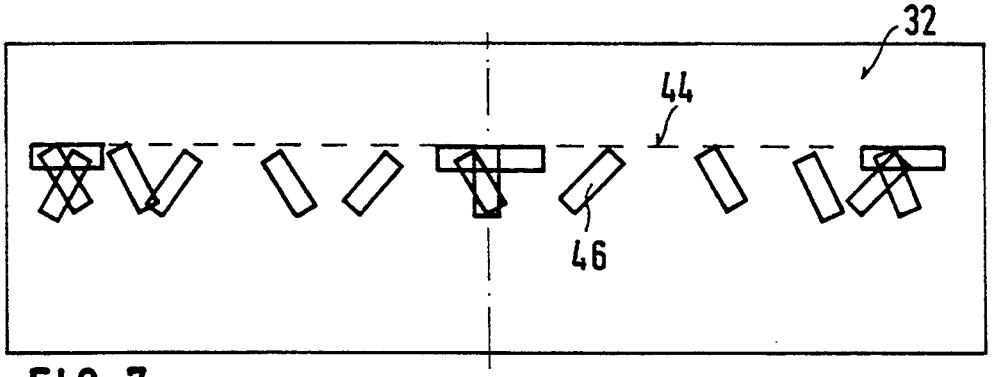
FIG. 7 is a view showing projections of the light body produced by the fog headlight on the measuring screen.

When the headlight is formed as a fog headlight, it produces an illumination intensity distribution 42 on the measuring screen 32 shown in FIG. 6. The illumination intensity distribution 42 has a great horizontal extension, for example up to approximately 45 degree to both sides of the vertical central plane V—V of the measuring screen 32. The extension of the illumination intensity distribution 42 in a vertical direction is substantially smaller, for example approximately from 1 degree under the horizontal central plane H—H of the measuring screen 32 up to approximately 6 degree under the horizontal central planes H—H. The illumination intensity distribution 42 has a substantially horizontal upper bright-dark limit 44 which is formed respective reflection of the light emitted by the light source 14 by the reflector 10 so that no screen cap is required. FIG. 7 shows projections 46 of the light source 14 which are reflected by reflector regions in the plane 40 identified in FIG. 1 on a diameter surrounding the optical axis 18.

All projections 46 are located under the bright-dark limit 44.

Figure 8:
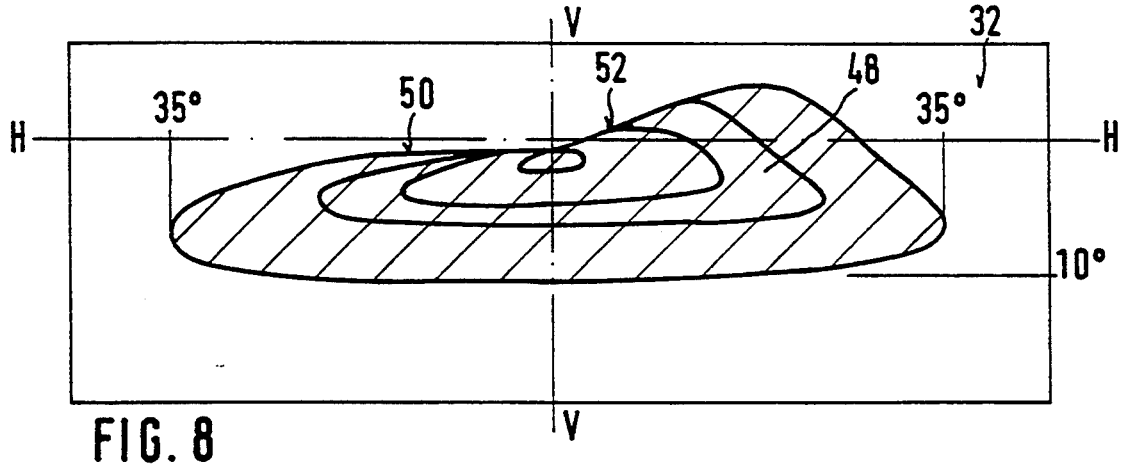
FIG. 8 is a view showing an illumination intensity distribution produced on the measuring screen by a headlight formed as an antidazzle headlight.
Figure 9:
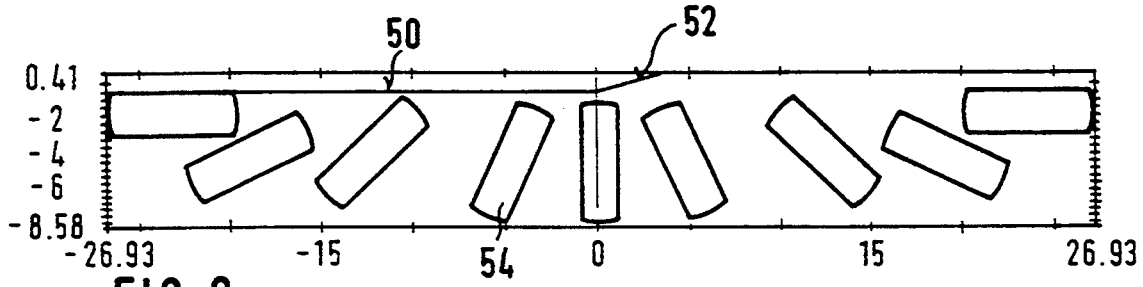
FIG. 9 is a view showing projections of the light body on the measuring screen produced by the antidazzle headlight.

When the headlight is formed as an antidazzle headlight, the illumination intensity distribution 48 on the measuring screen 32 shown in FIG. 8 is produced. The illumination intensity distribution 48 is asymmetrical relative to the vertical central plane V—V of the measuring screen 32 and has a horizontal upper bright-dark limit 50 at the left side from V—V (opposite traffic side) and an upper bright-dark limit 52 raising to the right at the right side of V—V (traffic side proper). The horizontal extension of the illumination density distribution 48 amounts to approximately 35 per cent at both sides of the vertical central plane V—V. In the vertical direction the illumination intensity distribution 48 extends from the upper, bright-dark limit 50 or 52 to approximately 10 degree under the horizontal central plane H—H. FIG. 9 shows projections 54 of the light source 14 which are reflected by reflector regions arranged in the plane 40 (FIG. 1) on a same diameter around the optical axis 18.

It will be understood that each of the elements described above, or two or more together, may also find a useful application in other types of constructions differing from the types described above.

While the invention has been illustrated and described as embodied in a headlight for vehicles, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A headlight for a vehicle, comprising a light source; a reflector reflecting light emitted by said light source as a light bundle converging at least in horizontal longitudinal planes, said reflector having a front edge facing in a light outlet direction; and a dispersing lens arranged in the region of said front edge of said reflector so that the light bundle reflected by said reflector passes through said dispersing lens, said reflector and said dispersing lens having shapes which are such and so determined relative to one another that the light emitted by said light source after reflection on said reflector and passage through said dispersing lens forms a light intensity distribution required for the vehicle headlight, said dispersing lens being a cylindrical lens having a cylinder axis extending substantially vertical and perpendicular to an optical axis of said reflector, said light source and said reflector being formed so that the light emitted by said light source is reflected by said reflector as a light beam which converges in horizontal planes and is substantially parallel in vertical planes, and then during passage through said cylindrical lens deviates in the horizontal planes but remains unaffected in the vertical planes.

2. A headlight as defined in claim 1, wherein said light source, said reflector and said dispersing lens are formed so as to produce the illumination intensity distribution which satisfies the requirements for a high beam.

3. A headlight as defined in claim 1, wherein said dispersing lens is formed as a fresnel lens.

4. A headlight as defined in claim 2, wherein said dispersing lens is composed of synthetic plastic material.

5. A headlight as defined in claim 3, wherein said dispersing lens is composed of synthetic plastic material.

6. A headlight as defined in claim 1, wherein said light source, said reflector and said dispersing lens are formed so that the illumination intensity distribution has an asymmetrical bright-dark limit and satisfies requirements for an asymmetrical antidazzle light.

7. A headlight as defined in claim 1, wherein said light source, said reflector and said dispersing lens are formed so that the illumination intensity distribution has a substantially horizontal bright-dark limit and satisfies the requirements for a fog light.

8. A headlight for a vehicle, comprising a light source; a reflector reflecting light emitted by said light source as a light bundle converging at least in horizontal longitudinal planes, said reflector having a front edge facing in a light outlet direction; and a dispersing lens arranged in the region of said front edge of said reflector so that the light bundle reflected by said reflector passes through said dispersing lens, said reflector and said dispersing lens having shapes which are such and so determined relative to one another that the light emitted by said light source after reflection on said reflector and passage through said dispersing lens forms a light intensity distribution required for the vehicle headlight, said light source and said reflector being formed so that the light emitted by said light source is reflected by said reflector as a light beam which converges in horizontal planes and is substantially parallel in vertical planes, and then during passage through said lens deviates in the horizontal planes but remains unaffected in the vertical planes.

* * * * *